US005282297A

United States Patent [19]

Angus

[11] Patent Number: 5,282,297

[45] Date of Patent: Feb. 1, 1994

[54] BELT BUCKLE

[75] Inventor: Mark J. Angus, Arlington, Tex.

[73] Assignee: Midas Leathercraft Tool Company, Inc., Fort Worth, Tex.

[21] Appl. No.: 907,728

[22] Filed: Jul. 2, 1992

[51] Int. Cl.[5] ..... A44B 11/00

[52] U.S. Cl. ..... 24/163 K

[58] Field of Search ..... 24/163 R, 163 K, 49 K, 24/49 A; 63/29.1

[56] References Cited

U.S. PATENT DOCUMENTS

| | | | |
|---|---|---|---|
| 403,112 | 5/1889 | Kaffeman | 63/29.1 |
| 1,610,848 | 12/1926 | Critchley | 24/163 K |
| 2,587,796 | 3/1952 | Whitehouse et al. . | |
| 2,634,484 | 4/1953 | Vaisey et al. . | |
| 4,052,773 | 10/1977 | Nesbitt . | |
| 4,053,966 | 10/1977 | Dieleman | 24/163 K X |
| 4,170,808 | 10/1979 | Knowles | 24/163 K |
| 4,502,188 | 3/1985 | Kohli . | |
| 4,570,308 | 2/1986 | Weisgerber . | |
| 4,691,460 | 9/1987 | Kohl . | |
| 4,972,557 | 11/1990 | Williams | 24/163 K |

FOREIGN PATENT DOCUMENTS

| | | | |
|---|---|---|---|
| 129336 | 7/1932 | Fed. Rep. of Germany | 24/163 K |
| 570905 | 5/1924 | France | 63/29.1 |
| 915360 | 11/1946 | France | 63/29.1 |

*Primary Examiner*—James R. Brittain
*Attorney, Agent, or Firm*—James E. Bradley

[57] ABSTRACT

A belt buckle for selectively displaying an ornamental member. An ornamental member is attached to the front face of the belt buckle plate utilizing a screw insertable through an aperture extending through the belt buckle plate. The ornamental member includes an ornamental plate having a threaded socket. The screw is inserted through the aperture and into the threaded socket so that an ornamental member may be attached to the belt buckle plate.

3 Claims, 2 Drawing Sheets

Fig. 3
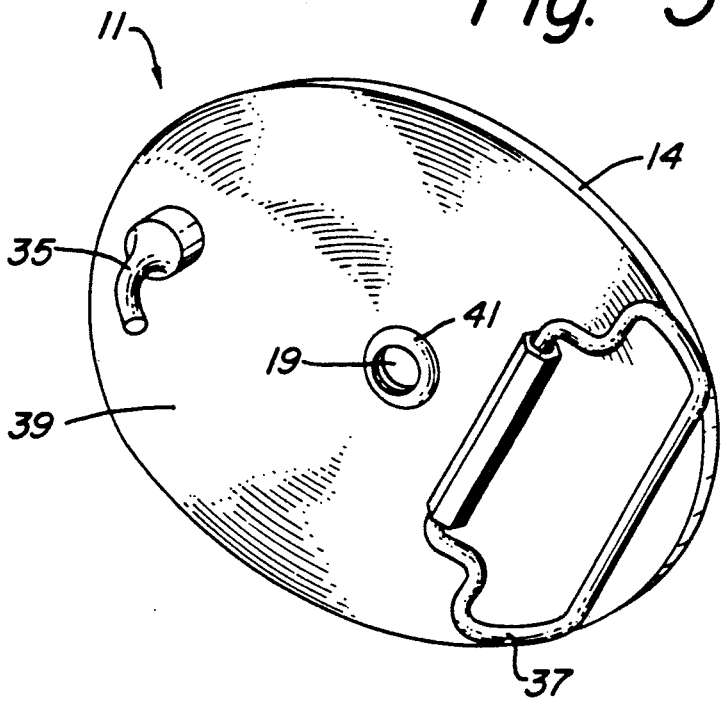
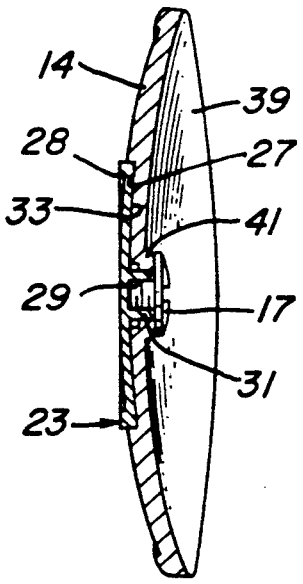
Fig. 4

BELT BUCKLE

BACKGROUND OF THE INVENTION

1. Technical Field

This invention relates in general to belt buckles and in particular to selectively displaying ornamental members on the front face of belt buckles.

2. Description of the Related Art

Belt buckles having an ornamental member displayed on the front are well known in the art. Typically, these belt buckles have initials, entire names, or college or sports emblems displayed and are often used as an accessory to be worn with Western clothing. One approach to producing these belt buckles has been to form the ornamental member and belt buckle as one part. A significant disadvantage to this approach is the high cost associated with the retail space required to stock a wide assortment of ornamental belt buckles.

Another approach has been to provide a standard belt buckle with a variety of attachable ornamental members. The ornamental members have been attached utilizing tabs that clip over the buckle, a window for displaying flat items, and flanges for sliding the ornamental member over the buckle.

Although this approach does reduce the amount of retail space required for displaying the belt buckles, the appearance of the belt buckles is not the same high quality as the single part belt buckles. It has been readily apparent to viewers that belt buckles with attachable ornamental members are of a two part construction.

SUMMARY OF THE INVENTION

In this invention, a belt buckle is provided for selectively displaying an ornamental member. An ornamental member is attached to the front face of the belt buckle plate utilizing fastening means insertable through an aperture extending through the belt buckle plate. The front face of the belt buckle plate includes a non-uniform recess surrounding the aperture for receiving the perimeter of the ornamental member. The ornamental member includes an ornamental plate having a threaded socket. The fastening means is inserted through the aperture and into the threaded socket so that an ornamental member may be attached to the belt buckle plate.

BRIEF DESCRIPTION OF THE DRAWING

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

FIG. 3 is a rear perspective view of a belt buckle without an ornamental member according to the present invention.

FIG. 4 is a sectional view of a belt buckle with an ornamental member attached according to the present invention.

DETAILED DESCRIPTION OF PREFERRED EMBODIMENT

Figure 1:
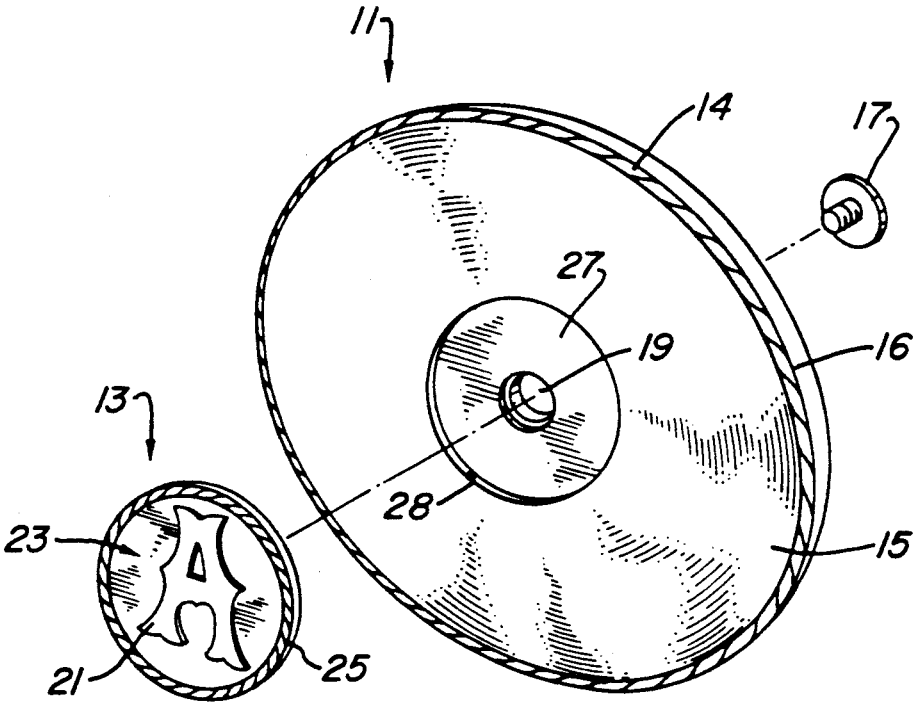
FIG. 1 is an exploded view of a belt buckle including an ornamental member according to the present invention.

With reference now to the figures and in particular with reference to FIG. 1, there is illustrated an exploded view of a belt buckle 11 including an ornamental member 13 according to the present invention. In a preferred embodiment, belt buckle 11 and ornamental member may be made of a metal such as silver, bronze, pewter, or gold.

Belt buckle comprises a plate 14, which typically has an oval-shaped perimeter 16, and a convex ornamental face 15. Ornamental member 13 is attached to the front face 15 of a belt buckle plate 14 utilizing a fastening means which preferably comprises a screw 17. In this manner, ornamental member 13 may also be removed and replaced with a different ornamental member 13. Belt buckle plate 14 includes an aperture 19 through which ornamental member 13 may be attached. Those skilled in the art will appreciate that multiple ornamental members 13 may be displayed on belt buckle 11 by providing multiple apertures 19.

Ornamental member 13 includes an ornamental design 21 for display, and ornamental plate 23, having a perimeter 25. Ornamental plate 23 includes an ornamental design 21 formed on ornamental plate 23. Ornamental design 21 may be an initial such as "A" as illustrated, a sports emblem, insignia, or any other type of ornamental design. The perimeter 25 of ornamental plate 23 is substantially larger than aperture 19 and is circular in the embodiment shown. In order for belt buckle 11 and ornamental member 13 to appear as a single part construction, it is important that perimeter 25 fits snugly against front face 15. Therefore, a recess 27 having a border wall 28 is provided on front face 15 to receive perimeter 25. Recess 27 is convex and comprises a recessed surface that matches and closely receives the perimeter 25. Perimeter 25 is slightly thicker than the depth of recess 27 at the border wall 30. Recess 27 surrounds aperture 19 and may be of varying depths so that ornamental member 13 appears to blend into belt buckle plate 14. Recess 27 is convex approximately to the same degree as front face 15.

Figure 2:
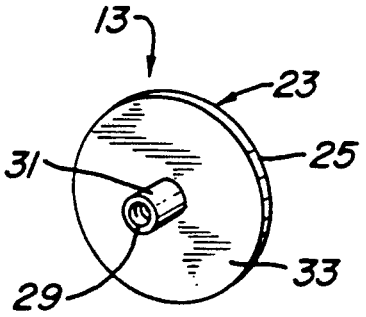
FIG. 2 is a rear perspective view of an ornamental member according to the present invention.

Referring now to FIG. 2, there is depicted a rear perspective view of ornamental member 13 according to the present invention. Ornamental member 13 is attached to belt buckle 11 by inserting screw 17 through aperture 19 (see FIG. 1) and into a threaded socket 29. Threaded socket 29 is included within a shank 31 which protrudes perpendicularly from the back face 33 of ornamental plate 23. Back face 33 is concave to match the convex recess 27. Shank 31 has an outer diameter slightly less than the diameter of aperture 19 and is inserted into aperture 19.

With reference to FIG. 3, there is illustrated a rear perspective view of belt buckle 11 without ornamental member 13 according to the present invention. The back face 39 of belt buckle plate 14 includes a loop 37 preferably for attaching to the end of a belt adapted for use with belt buckle 11 and a hook 35 for securing the opposite end of the belt around a wearer.

Back face 39 of belt buckle plate 14 forms a concave surface. A circular shoulder 41 is included on and protrudes from back face 39, surrounding aperture 19 for permitting screw 17 (see FIG. 1) to be tightly secured within threaded socket 29 (see FIG. 2).

Referring to FIG. 4, there is depicted a sectional view of belt buckle 11 with ornamental member 13 attached according to the present invention. Ornamental plate 23 is attached to belt buckle plate 14 utilizing screw 17. As illustrated in FIG. 4, shank 31 protrudes partially through aperture 19 from front face 15 of be)t buckle plate 14 to back face 39. Shoulder 41 permits screw 17 to be tightly secured within threaded socket 29 of shank 31. The length of screw 17 is less than the distance from shoulder 41 to the bottom of threaded socket 29. The head of screw 17 abuts shoulder 41 and is larger in diameter than aperture 19. The back face 33 of ornamental plate 23 Will be substantially flush with recess 27. The thickness of ornamental plate 23 is slightly greater than the depth of recess 27.

In operation, an ornamental member 13 is selected for display. A wearer then attaches ornamental member 13 to belt buckle 11 by inserting shank 31 into aperture 19. Screw 17, is inserted into threaded socket 29 of shank 31 in order to secure ornamental member 13 to belt buckle plate 14. In this manner, perimeter 25 of ornamental plate 23 fits snugly into recess 27 so that belt buckle 11 and ornamental member 13 appear to be manufactured as a single part.

The invention has significant advantages. The attachable ornamental member reduces the amount of inventory required. The ornamental member appears as being integrated with the belt buckle once attached.

While the invention has been particularly shown and described with reference to a preferred embodiment, it will be understood by those skilled in the art that various changes in form and detail may be made therein without departing from the spirit and scope of the invention.

I claim:

1. A belt buckle for selectively displaying an ornamental member comprising:

a belt buckle plate having a front face, a back face, and a perimeter, wherein the front face, the back face and the perimeter form an integral belt buckle plate, wherein the front face of the belt buckle plate is convex and the back face of the belt buckle plate is concave;

a recess formed on the front face of the belt buckle plate and having a perimeter with a border wall spaced inward from the perimeter of the belt buckle plate, wherein the recess of the belt buckle plate is convex;

an aperture extending through the belt buckle plate from the recess on the front face to the back face;

an ornamental member comprising an ornamental plate having a front face, a back face, and a threaded socket integrally joined to the back face of the ornamental plate, wherein the ornamental plate has a perimeter that has substantially the same configuration and size as the perimeter of the recess for nesting snugly within the border wall of the recess, wherein the perimeter of the ornamental plate is closely received by the border wall so that the belt buckle and the ornamental member appear to be manufactured as one part, and further wherein the back face of the ornamental member abuts the recess, and the perimeter of the ornamental member abuts the perimeter of the recess, wherein the back face of the ornamental plate is concave; and fastening means insertable through the aperture into the threaded socket for attaching the ornamental member to the recess on the front face of the belt buckle plate, wherein the ornamental member may be easily replaced with a different ornamental member.

2. A belt buckle for selectively displaying an ornamental member comprising:

a belt buckle plate having a convex front face, a concave back face, and a perimeter, wherein the convex front face, the concave back face and the perimeter form an integral belt buckle plate;

a circular recess on the convex front face of the belt buckle, the recess having a convex surface and a border wall spaced inward from the perimeter of the belt buckle plate;

an aperture extending through the center of the recess of the belt buckle plate from the front face to the back face;

a shoulder surrounding the aperture and protruding from the back face of the belt buckle plate;

an ornamental member comprising:

an ornamental plate having a convex front face, a concave back face, and a perimeter, wherein the concave back face of the ornamental member abuts the recess, and the perimeter of the ornamental member abuts the perimeter of the recess;

an ornamental design formed on the front face; and a shank protruding from the back face of the ornamental plate and inserted into the aperture, wherein the shank includes a threaded socket;

a screw inserted through the aperture into the threaded socket for attaching the ornamental member to the front face of the belt buckle plate, wherein the threaded socket is slightly recessed from the shoulder, the screw having a head that bears against the shoulder, and further wherein the perimeter of the ornamental plate is closely received by the border wall so that the belt buckle and the ornamental member appear to be manufactured as one part.

3. The belt buckle according to claim 2, wherein the perimeter of the ornamental plate has a thickness that is slightly greater than the depth of the recess at the border wall.

* * * * *